US007686577B2

(12) United States Patent
Morrison et al.

(10) Patent No.: US 7,686,577 B2
(45) Date of Patent: Mar. 30, 2010

(54) STACKED LAMINATE FIBER WRAPPED SEGMENT

(75) Inventors: Jay A. Morrison, Oviedo, FL (US); David C. Radonovich, Winter Park, FL (US); Anthony L. Schiavo, Oviedo, FL (US); Gary B. Merrill, Orlando, FL (US); Malberto F. Gonzalez, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 818 days.

(21) Appl. No.: 11/591,907

(22) Filed: Nov. 2, 2006

(65) Prior Publication Data

US 2008/0107521 A1 May 8, 2008

(51) Int. Cl.
*F01D 25/26* (2006.01)

(52) U.S. Cl. ..... 415/139; 415/173.1; 415/173.3; 415/173.4

(58) Field of Classification Search ..... 415/134, 415/135, 138, 139, 173.1, 173.3, 173.4, 174.2, 415/174.4, 189, 196, 209.2, 214.1; 29/889.2
See application file for complete search history.

(56) References Cited

U.S. PATENT DOCUMENTS

| | | | | |
|---|---|---|---|---|
| 4,218,276 | A | 8/1980 | King | |
| 4,786,343 | A | 11/1988 | Hertzberg | |
| 4,815,907 | A | 3/1989 | Williamson et al. | |
| 4,895,108 | A | 1/1990 | Caputo et al. | |
| 4,897,021 | A * | 1/1990 | Chaplin et al. | 415/173.7 |
| 5,928,448 | A | 7/1999 | Daws | |
| 6,048,170 | A * | 4/2000 | Dodd | 415/135 |
| 6,062,351 | A | 5/2000 | Strasser et al. | |
| 6,143,432 | A | 11/2000 | De Rochemont et al. | |
| 6,265,333 | B1 | 7/2001 | Dzenis et al. | |
| 6,397,603 | B1 | 6/2002 | Edmondson et al. | |
| 6,497,776 | B1 | 12/2002 | Butler et al. | |
| 6,932,566 | B2 * | 8/2005 | Suzumura et al. | 415/135 |
| 7,534,086 | B2 * | 5/2009 | Mazzola et al. | 415/173.1 |
| 2003/0021628 | A1 | 1/2003 | Gudaitis et al. | |
| 2004/0005216 | A1 * | 1/2004 | Suzumura et al. | 415/173.3 |
| 2004/0047726 | A1 * | 3/2004 | Morrison | 415/116 |
| 2005/0100726 | A1 | 5/2005 | Millard et al. | |
| 2005/0112321 | A1 | 5/2005 | Millard et al. | |
| 2006/0140753 | A1 * | 6/2006 | Romanov et al. | 415/173.1 |

FOREIGN PATENT DOCUMENTS

| | | | |
|---|---|---|---|
| WO | WO 87/05976 | A1 | 10/1987 |
| WO | WO 2005/044559 | A1 | 5/2005 |

* cited by examiner

*Primary Examiner*—Edward Look
*Assistant Examiner*—Aaron R Eastman

(57) ABSTRACT

A ceramic ring segment for a turbine engine that may be used as a replacement for one or more metal components. The ceramic ring segment may be formed from a plurality of ceramic plates, such as ceramic matrix composite plates, that are joined together using a strengthening mechanism to reinforce the ceramic plates while permitting the resulting ceramic article to be used as a replacement for components for turbine systems that are typically metal, thereby taking advantage of the properties provided by ceramic materials. The strengthening mechanism may include a ceramic matrix composite overwrap or plurality of overwraps designed to help prevent delamination of the ceramic plates when the ceramic article is in use by placing the plates in compression.

12 Claims, 2 Drawing Sheets

STACKED LAMINATE FIBER WRAPPED SEGMENT

FIELD OF THE INVENTION

This invention is directed generally to ceramic articles, and more particularly to ceramic articles that may be used in a turbine system as a replacement for metal components.

BACKGROUND OF THE INVENTION

Conventional gas turbine engines operate at high temperatures and therefore, many of the systems within the engine are formed from metals capable of withstanding the high temperature environments. For example, gas turbine systems often include ring segments that are stationary gas turbine components located between stationary vane segments at the tip of a rotating turbine blade or airfoil. Ring segments are exposed to high temperatures and high velocity combustion gases and are typically made from metal. While the metal is capable of withstanding the operating temperatures, the metal is often cooled to enhance the usable life of the ring segments. Many current ring segment designs use a metal ring segment attached either directly to a metal casing or support structure or attached to metal isolation rings that are attached to the metal casing or support structure. More recently, firing and/or operating temperatures of turbine systems have increased to improve engine performance. As a result, the ring segments have required more and more cooling to prevent overheating and premature failure. Even with thermal barrier coatings, active cooling is still necessary.

Ceramic materials, such as ceramic matrix composites, have higher temperature capabilities than metal alloys and therefore, do not require the same amount of cooling, resulting in a cooling air savings. Prior art ring segments made from CMC materials rely on shell-type structures with hooks or similar attachment features for carrying internal pressure loads. U.S. Pat. No. 6,113,349 and U.S. Pat. No. 6,315,519 illustrate ring segments with C-shaped hook attachments. Conventional ceramic matrix components are formed from layers of fibers positioned in planes and layers substantially parallel to the inner sealing surface of the ring segments. For cooled components, internal pressurization would load these attachment hooks in such a way as to cause high interlaminar tensile stresses. Other out-of-plane features common in laminated structures, such as T-joints, are also subject to high interlaminar stresses when loaded. One of the limitations of laminated ceramic matrix composite (CMC) materials, whether oxide or non-oxide based, is that their strength properties are not generally uniform in all directions (e.g. the interlaminar tensile strength is generally less than about 5% of the in-plane strength). Nonuniform fiber perform compaction in complex shapes and anisotropic shrinkage of matrix and fibers results in delamination defects in small radius corners and tightly curved sections, further reducing the already-low interlaminar properties. Load carrying capability in a direction normal to the fiber plane is still severely limited. Thus, a need exists for construction method for laminated ceramic composite materials which provides attachment features with high load carrying capability. Furthermore, a need exists for a ceramic article that has both improved load carrying attachment features and high structural integrity in a direction normal to the laminate plane. In addition, a need exists for a ceramic article that may be used as a replacement material for metal parts in turbine systems to improve the efficiencies of the turbine systems.

SUMMARY OF THE INVENTION

The present invention is directed to a ceramic article that may be used as a replacement for one or more metal components used in a turbine engine. The ceramic articles may include the use of a plurality of ceramic plates, such as ceramic matrix composite plates, that may be positioned together and reinforced using a strengthening mechanism selected to provide reinforcement to the ceramic plates to increase the strength of the assembly of plates. The ceramic matrix composite plates may be joined together or may be positioned together without being joined together. The strengthening mechanism may be located within one or more locations of the ceramic article. As such, the ceramic articles may be used as a replacement for one or more parts in a turbine system that are typically metal, thereby enabling the greater temperature capacity of the ceramic materials to be utilized such that the efficiencies of the turbine systems may be increased relative to prior art systems.

The ceramic article may be a ring segment for a turbine engine formed from a plurality of ceramic plates positioned such that side surfaces of the plates contact side surfaces of adjacent plates forming an inner sealing surface for turbine blade tips in a turbine engine. The plurality of ceramic plates may be coupled together with one or more strengthening mechanisms, wherein the strengthening mechanism may place the ceramic plates under compression in a direction generally orthogonal to the side surfaces of the plates and in a direction that is generally parallel to the inner sealing surface. The strengthening mechanism may comprise one or more ceramic matrix composite over-wraps around the plurality of ceramic plates. The ceramic plates may be formed from fiber layers generally orthogonal to the inner sealing surface of the plurality of ceramic plates. The fiber layers may have fiber orientations such as 0/90 degrees and plus/minus 45 degrees. The ceramic matrix composite over-wraps may be selected from a group consisting of a fiber, a fabric sheet, a tow, a braided strip, and any combination thereof. One or more of the plurality of ceramic plates, and in one embodiment, each ceramic plate may include a first foot extending from a backside of the ceramic plate opposite to the inner sealing surface and at the first end, wherein the ceramic matrix composite over-wrap is positioned on the first foot. One or more of the plurality of ceramic plates, and in one embodiment, each ceramic plate may include a second foot extending from a backside of the ceramic plate opposite to the inner sealing surface and at the second end, wherein the at least one ceramic matrix composite over-wrap is positioned on the second foot.

A method of forming a ring segment for a turbine engine may include coupling together a plurality of ceramic plates positioned such that side surfaces of the plates contact side surfaces of adjacent plates forming an inner sealing surface for turbine blade tips in a turbine engine. The method may also include securing the plurality of ceramic plates together with at least one strengthening mechanism, wherein the at least one strengthening mechanism places the ceramic plates under compression in a direction generally orthogonal to the side surfaces of the plates and in a direction that is generally parallel to the inner sealing surface, wherein the strengthening mechanism comprises at least one ceramic matrix composite over-wrap around the plurality of ceramic plates. Coupling together a plurality of ceramic plates may include coupling together a plurality of ceramic plates formed from fiber layers generally orthogonal to the inner sealing surface of the plurality of ceramic plates. The plurality of ceramic plates may be secured together with at least one ceramic matrix composite over-wrap formed from fiber layers generally orthogonal to the inner sealing surface of the plurality of ceramic plates. The plurality of ceramic plates may be secured together with at least one ceramic matrix composite over-wrap formed from fiber layers having fiber orientations such as, but not limited to, 0 degrees, 0/90 degrees and plus/minus 45 degrees, or other fiber configurations such as braided strips or ropes where fiber angles could be anywhere between 0 degrees and plus/minus 60 degrees.

Securing the plurality of ceramic plates together with at least one strengthening mechanism may include securing the plurality of ceramic plates together with at least one ceramic matrix composite over-wrap formed from a group consisting of a fiber, a fabric sheet, a tow, a braided strip, and any combination thereof. Securing the plurality of ceramic plates together with at least one strengthening mechanism may also include securing the plurality of ceramic plates together wherein each of the plurality of ceramic plates includes a first foot extending from a backside of the ceramic plate opposite to the inner sealing surface and at the first end, wherein the at least one ceramic matrix composite over-wrap is positioned on the first foot. Securing the plurality of ceramic plates together with at least one strengthening mechanism may include securing the plurality of ceramic plates together with at least one ceramic matrix composite over-wrap wherein each of the plurality of ceramic plates includes a second foot extending from a backside of the ceramic plate opposite to the inner sealing surface and at the second end, wherein the at least one ceramic matrix composite over-wrap is positioned on the second foot.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
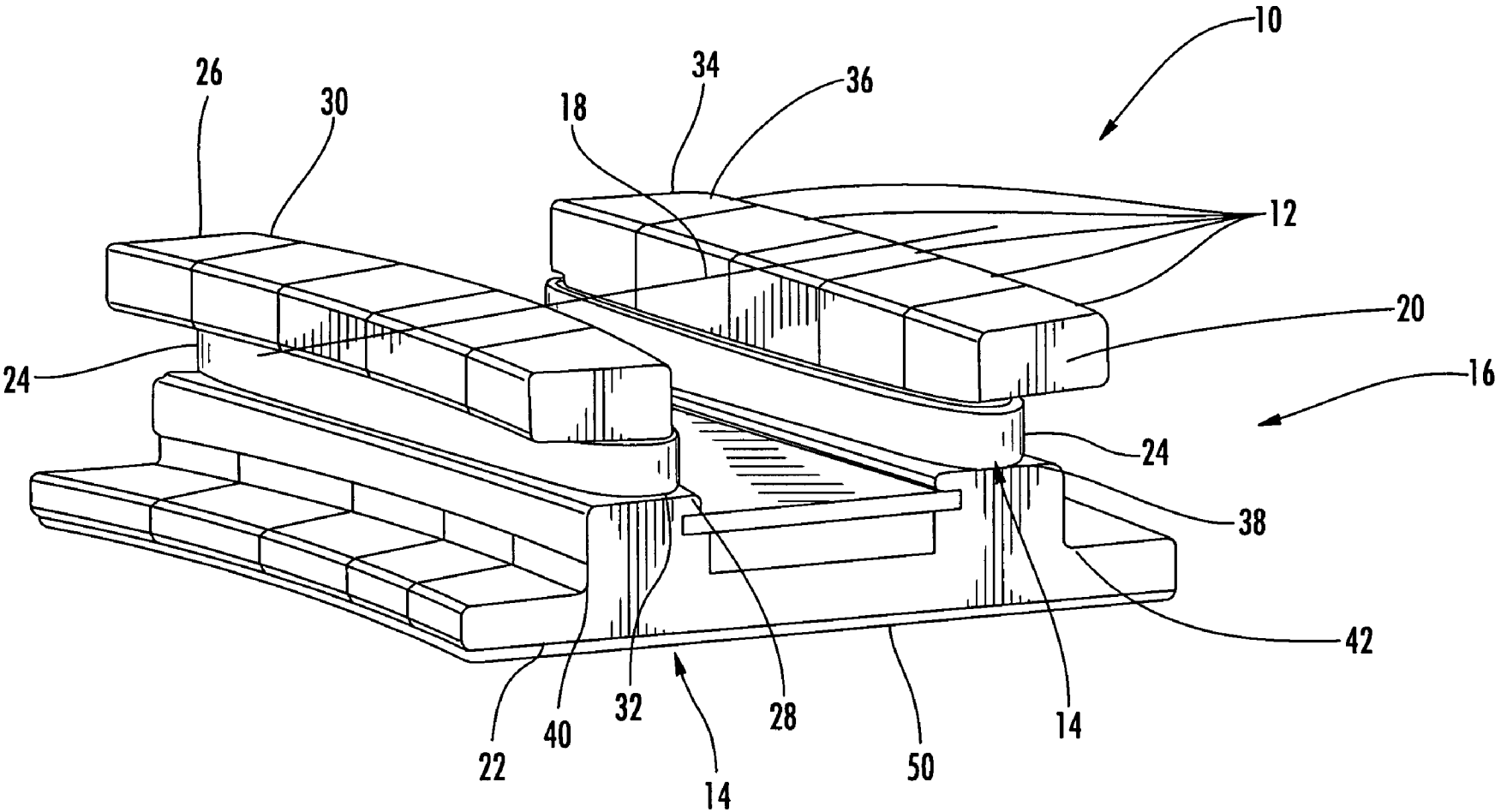
FIG. 1 shows a perspective view of a reinforced ceramic article according to one embodiment of the present invention.
Figure 2:
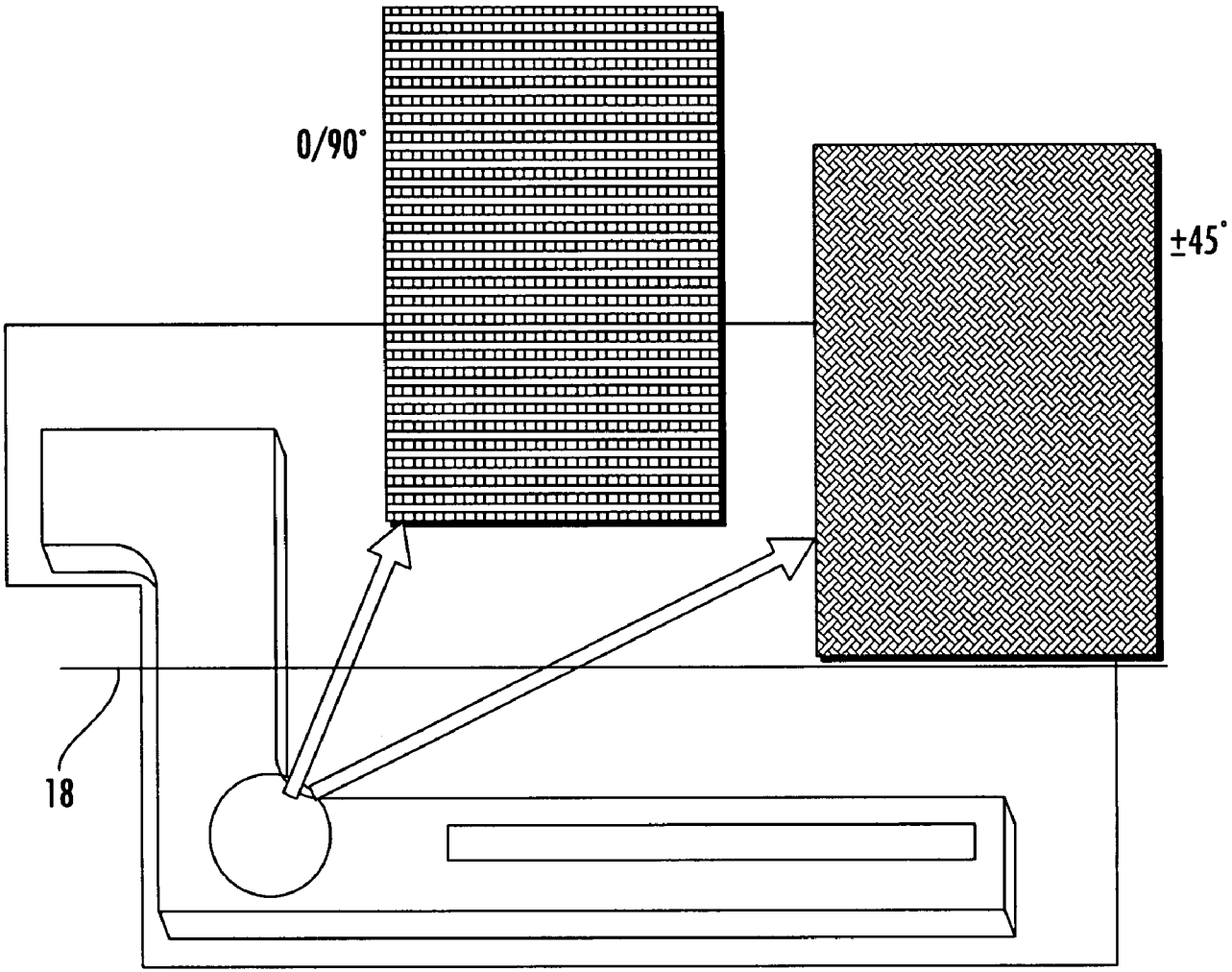
FIG. 2 discloses a partial cross-sectional view of material used to form a portion of the ceramic article taken at 2-2 in FIG. 1.

As shown in FIGS. 1 and 2, the present invention is directed to a ceramic article 10 that may be used as a replacement for one or more metal components used in a turbine engine. The ceramic article 10 may be formed from CMC oriented unconventionally. In particular, the CMC may be positioned generally orthogonal to a inner sealing surface 22 such that the plane of reinforcing fibers is orthogonal to hot gas path. Such a configuration allows use of hooks and other attachment features where the loading is resisted by the CMC in the strongest direction of the CMC. In addition, the weak interlaminar bonds are oriented generally orthogonal to a inner sealing surface 22, which is the lowest load direction, and are reinforced as described below.

The ceramic articles 10 may include the use of a plurality of ceramic plates 12, such as ceramic matrix composite plates, that may be positioned together and reinforced using a strengthening mechanism 14 selected to provide reinforcement to the ceramic plates 12 to increase the strength of the assembly of plates. The ceramic matrix composite plates 12 may be joined together or may be positioned together without being joined together. The strengthening mechanism 14 is selected such that it is located within one or more locations of the ceramic article. As such, the ceramic articles 12 may be used as a replacement for one or more parts in a turbine system that are typically metal, thereby enabling the greater temperature capacity of the ceramic materials to be utilized such that the efficiencies of the turbine systems may be increased relative to prior art systems.

Accordingly, in one aspect of the present invention, the ceramic article 10 includes a plurality of ceramic plates 12 that are joined together and then reinforced using a strengthening mechanism 14. By utilizing a plurality of ceramic plates 12, the ceramic plates 12 may be shaped as desired to form the selected shape of the final ceramic article 10. As such, the ceramic article 10 may be shaped to form parts that were, in the prior art, composed of metals or metal alloys, thereby taking advantage of the physical properties of the ceramic materials used to form the ceramic plates 12. In addition, the ceramic articles 10 are easier to manufacture than the conventionally formed CMC articles, may be easily replicated, and/or may have more design flexibility. It is to be understood that the ceramic articles 10 of the present invention may be used to form other structures used in a gas turbine system or in any other system wherein the advantages of using a ceramic material over a metal material may be understood and recognized.

Ceramic plates 12, while offering superior attributes to metal in two dimensions, generally have lower interlaminar strengths as compared to metal articles. The number, shape and thickness of the ceramic plates 12 used to form the ceramic articles 10 of the present invention may vary depending on one or more factors including, but not limited to, the ceramic article 10 to be formed, the ceramic material used to form the ceramic plates 12, the selected properties of the ceramic article 10 to be formed, the selected properties of the ceramic plates 12, the type of strengthening mechanism 14 to be used, or a combination thereof. The ceramic articles 10 may be composed of one or more ceramic materials that are generally used in the formation of ceramic articles 12 and/or ceramic matrix materials. Examples of ceramic materials that may be used to form the ceramic articles 10 include, but are not limited to, cerium oxide, graphite, silicon, alumina, zirconia, glass, ferrites, silicon carbide, silicon nitride, sapphire, cordierite, mullite, magnesium oxide, zirconium oxide, boron carbide, aluminum oxide, tin oxide, cryolite powders, scandium oxide, hafnium oxide, yttrium oxide, spinel, garnet, lanthanum fluoride, calcium fluoride, boron nitride, steatite, lava, aluminum nitride, iron oxide, quartz, porcelain, forsterite or combinations thereof, as well as any other crystalline inorganic nonmetallic material or clay.

The ceramic articles 10 may include the use of a strengthening mechanism 14. The strengthening mechanism 14 is selected to increase the strength of the structure 10 formed by a plurality of ceramic plates 12. The strengthening mechanism 14 is selected to be placed within the ceramic article 10 to help reinforce the article 10 and/or prevent delamination of the ceramic plates 12 that compose the overall ceramic article 10. Therefore, the strengthening mechanism 10 serves to reinforce the stack of ceramic plates or segments normal to the plane of the plates 12 and/or to help inhibit separation of the ceramic plates 12. The number and location of the strengthening mechanisms 14 used may be optimized based upon one or more factors including, but not limited to, the local stresses to be applied to the ceramic article 10, the type of ceramic article 10, the type of strengthening mechanism 14 used, and/or the type of ceramic material used to form the ceramic article 10.

In one embodiment of the present invention, the ceramic article 10 is a gas turbine ring segment 16. In this embodiment, the ceramic plates 12 may be ceramic laminates formed from a ceramic matrix composite (CMC) material. The ceramic plates 12 may be formed and shaped such that the strong plane of the CMC material is oriented substantially perpendicular to the hot gas path surface of the ring segment 16, as shown in FIG. 2, and substantially parallel to the front-to-aft axis 18 of the ring segment 16. As such, the loads perpendicular to the hot gas path (i.e. differential pressure) may be carried in the strongest orientation of the laminated material of the ceramic plates 12. The CMC material, as shown in FIG. 2, may be formed from fibers in alternating layers of 0/90 degree orientation and plus/minus 45 degree orientation, formed from layers of 0/90 degree orientation or plus/minus 45 degree orientation. After the CMC laminates have been stacked and attached to each other, the final shape of the ring segment 16 may be formed, such as by cutting the ceramic material to a selected final shape. The cutting may be accomplished using any known procedures including, but not limited to, programmable laser methods or water jet methods.

The ring segment 16 may be formed from a plurality of ceramic plates 12 positioned such that side surfaces 20 of the plates 12 contact side surfaces 20 of adjacent plates 12 forming an inner sealing surface 22 for turbine blade tips in a turbine engine. The plurality of ceramic plates 12 may be coupled together with one or more strengthening mechanisms 14, wherein the at least one strengthening mechanism 14 may place the ceramic plates 12 under compression in a direction generally orthogonal to the side surfaces 20 of the plates 12 and in a direction that is generally parallel to the inner sealing surface 22.

In one embodiment, the strengthening mechanism is a ceramic matrix composite (CMC) over-wrap 24 that is wrapped around a portion of the ceramic article. The over-wrap 24 may be composed of a ceramic matrix composite material or other appropriate materials. As shown in FIG. 1, the over-wrap 24 may be in the form of a fiber, a sheet, a fabric, a tow, braided strips or other appropriate materials. In an alternative embodiment, a combination of over-wraps 24 may be used with the over-wraps 24 being in the form of a fiber, a sheet, a fabric, a tow, braided strips, or a combination thereof. The over-wrap 24 may be placed around the ceramic article in one or more locations to help reinforce the ceramic article 10. The over-wrap 24 may be placed around the ceramic article 10 after formation of the ceramic article 10 or during formation of the ceramic article 10. In one embodiment, the over-wrap 24 is placed around the ceramic article 10 after the article 10 is fully or nearly fully fired such that the natural shrinkage of the CMC over-wrap 24 may be used to induce residual compressive stress on the article 10.

For example, a NEXTEL 720 fiber reinforced alumina composite made by COI Ceramics Inc. has been used to form the ceramic plates 12 and the over-wrap 24. When the over-wrap 24 is placed onto fully fired ceramic plates 12, the over-wrap 24 will result in a differential shrinkage strain of 0.1% to 0.3%, depending on the firing temperature of the final assembly. This strain will impose an interlaminar compressive stress on the laminate stack, thus adding to the load-carrying capability in this direction. The ceramic matrix composite over-wrap 24 may also be formed from a material having a higher CTE than fibers forming the ceramic plates 12. In addition, the ceramic matrix composite over-wrap 24 may be formed from a different composition with different sintering shrinkage than the ceramic plates 12, such as a material with a greater sintering shrinkage. The process of coupling the over-wrap 24 to the ceramic plates 12 may include securing the plurality of ceramic plates together with at least one strengthening mechanism 14 and applying a processing temperature to the over-wrap 24 to provide a defined shrinkage differential and compressive preload to the plurality of ceramic plates 12. The over-wrap 24 and ceramic plates 12 may also be subjected to an intermediate firing stage before application of the over-wrap 24 so that shrinkage may be controlled at final firing of the ring segment 16.

In an alternative embodiment, alternative fibers may be used for the over-wrap material 24 to achieve further shrinkage and/or coefficient of thermal expansion (CTE) mismatch pre-stressing. For example, in the case above, if the overwrap fiber is NEXTEL 610 alumina, with a higher CTE than NEXTEL 720 mullite fiber, a differential shrinkage of 0.2% to 1.0% can be achieved by a combination of CTE and sintering shrinkage. In some embodiments of the present invention, the over-wrap 24 may be located in or adjacent to regions of interlaminar tensile stress. For thermally induced stresses, it may be beneficial to locate the wrap 24 around the neutral axis of bending.

In another embodiment, the over-wrap material 24 may be processed after placement on the ceramic article 10. This secondary processing may be used to permit for alternative CMC materials to be used for the over-wrap 24, particularly if the over-wrap 24 is to be located within a colder region removed from the inner sealing surface 22 of the ceramic article 10 when in use. For example, an aluminosilicate matrix material having superior bond strength and increased shrinkage may be used in the cooler regions of the over-wrap 24.

As shown in FIG. 1, each ceramic plate 12 may include a first foot 26 positioned on a backside surface 28 at a first end 40. The backside surface 28 may be generally opposite the inner sealing surface 22. The first foot 26 may extend generally orthogonally from the backside surface 28 and may include an outer attachment section 30. The outer attachment section 30 may be spaced a sufficient distance to form an over-wrap attachment section 32 on the first foot 26. Each ceramic plate 12 may also include a second foot 34 positioned on the backside surface 28 at a second end 42. The second foot 34 may extend generally orthogonally from the backside surface 28 and may include an outer attachment section 36. The outer attachment section 36 may be spaced a sufficient distance to form an over-wrap attachment section 38 on the second foot 34.

As shown in FIG. 1, the ceramic article 10 may include an abradable and insulative coating 50 on the inner sealing surface 22. The abradable coating 50 may be any conventional or not yet developed abradable coating. The abradable coating 50 may be attached to the inner sealing surface 22 through any appropriate method and may include insulative properties in some embodiments.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A ring segment for a turbine engine, comprising:

at least one ceramic plate forming an inner sealing surface for turbine blade tips in a turbine engine;

at least one strengthening mechanism coupled to the at least one ceramic plate, wherein the at least one ceramic plate comprises at least two ceramic plates, wherein the at least one strengthening mechanism places the ceramic plates under compression in a direction generally orthogonal to the side surfaces of the plates and in a direction that is generally parallel to the inner sealing surface;

wherein the strengthening mechanism comprises at least one ceramic matrix composite over-wrap around the at least two ceramic plates; and wherein the at least two ceramic plates are formed from a plurality of layers of fibers, wherein the layers are positioned generally orthogonal to the inner sealing surface.

2. The ring segment of claim 1, wherein the at least one ceramic plate comprises a plurality of ceramic plates positioned such that side surfaces of the plates contact side surfaces of adjacent plates.

3. The ring segment for a turbine engine of claim 2, wherein the fiber layers have fiber orientations selected from the group consisting of 0/90 degrees and plus/minus 45 degrees.

4. The ring segment for a turbine engine of claim 2, wherein at least one of the plurality of ceramic plates includes a first foot extending from a backside of the ceramic plate opposite to the inner sealing surface and at the first end, wherein the at least one ceramic matrix composite over-wrap is positioned on the first foot.

5. The ring segment for a turbine engine of claim 4, wherein each of the plurality of ceramic plates includes a second foot extending from a backside of the ceramic plate opposite to the inner sealing surface and at the second end, wherein the at least one ceramic matrix composite over-wrap is positioned on the second foot.

6. The ring segment for a turbine engine of claim 1, wherein the at least one ceramic matrix composite over-wrap is formed from a material having a higher CTE than fibers forming the ceramic plates.

7. The ring segment for a turbine engine of claim 1, wherein the at least one ceramic matrix composite over-wrap is formed from a different composition with different sintering shrinkage than the ceramic plates.

8. The ring segment of claim 1, further comprising an abradable coating on the inner sealing surface.

9. A ring segment for a turbine engine, comprising:

a plurality of ceramic plates positioned such that side surfaces of the plates contact side surfaces of adjacent plates forming an inner sealing surface for turbine blade tips in a turbine engine;

wherein the plurality of ceramic plates are coupled together with at least one strengthening mechanism, wherein the at least one strengthening mechanism places the ceramic plates under compression in a direction generally orthogonal to the side surfaces of the plates and in a direction that is generally parallel to the inner sealing surface;

wherein each of the plurality of ceramic plates includes a first foot extending from a backside of the ceramic plate opposite to the inner sealing surface and at the first end and a second foot extending from a backside of the ceramic plate opposite to the inner sealing surface and at the second end;

wherein the at least one strengthening mechanism is at least one ceramic matrix composite over-wrap positioned on the first foot and at least one ceramic matrix composite over-wrap on the second foot; and wherein the ceramic plates are formed from fiber layers generally orthogonal to the inner sealing surface of the plurality of ceramic plates.

10. The ring segment of claim 9, wherein the fiber layers have fiber orientations selected from the group consisting of 0/90 degrees and plus/minus 45 degrees.

11. The ring segment for a turbine engine of claim 9, wherein the at least one ceramic matrix composite over-wraps on the first and second feet are selected from a group consisting of a fiber, a fabric sheet, a tow, a braided strip, and any combination thereof.

12. The ring segment of claim 9, further comprising an abradable coating on the inner sealing surface.

* * * * *